US005479899A

United States Patent [19]

Phelps

[11] Patent Number: 5,479,899

[45] Date of Patent: Jan. 2, 1996

[54] FUEL MANAGEMENT SYSTEM

[75] Inventor: Harold E. Phelps, Winston-Salem, N.C.

[73] Assignee: Phelps Fuel Systems, Inc., Winston-Salem, N.C.

[21] Appl. No.: 322,922

[22] Filed: Oct. 13, 1994

[51] Int. Cl.[6] ..... F02M 37/04

[52] U.S. Cl. ..... 123/463; 123/462

[58] Field of Search ..... 123/510, 462, 123/463, 464, 512, 73 AD, 73 B, 73 R

[56] References Cited

U.S. PATENT DOCUMENTS

| | | | |
|---|---|---|---|
| 1,955,037 | 4/1934 | Uiel | 123/463 |
| 2,305,912 | 12/1942 | Thompson | 123/463 |
| 2,598,202 | 5/1952 | Wirth | 123/462 |
| 2,790,433 | 4/1957 | Catford | 123/462 |
| 2,958,321 | 11/1960 | Haase | 123/462 |
| 4,142,683 | 3/1979 | Casey | 123/470 |
| 4,551,026 | 11/1985 | DuBois | 123/73 AD |
| 4,590,896 | 5/1986 | Wissman | 123/73 R |
| 4,617,898 | 10/1986 | Gayler | 123/470 |
| 4,694,804 | 9/1987 | Degrazia | 123/462 |
| 4,976,246 | 12/1990 | Schierling | 123/73 AD |

FOREIGN PATENT DOCUMENTS

| | | | |
|---|---|---|---|
| 989983 | 4/1965 | United Kingdom | 123/464 |

*Primary Examiner*—Carl S. Miller

*Attorney, Agent, or Firm*—Gifford, Krass, Groh, Sprinkle, Patmore, Anderson & Citkowski

[57] ABSTRACT

A fuel management system for small internal combustion engines in which metered quantities of fuel are delivered by way of a variable volume, positive displacement pump to a fuel air mixing chamber in pulses timed with the rotation of the engine.

16 Claims, 1 Drawing Sheet

FUEL MANAGEMENT SYSTEM

This invention relates to fuel supply or management systems for small internal combustion engines.

The operation of small internal combustion engines which are used with a variety of tools and equipment, such as lawn mowers chainsaws, leaf blowers and the like require that the carburetor or fuel control system be simple and capable of controlling operation in all possible positions of the engine. At the same time the engine must be controlled so that it operates effectively, prevents the exhaust of unburned fuel and oil to the atmosphere. Present trends in the requirements to protect the environment make it necessary and desirable that fuel tanks be closed and not vented to the atmosphere to prevent the escape of fuel vapors. This requirement makes it difficult to use fuel control systems with a return line for redirecting any excess fuel not used by the engine to the fuel tank because the return fuel line aggravates the problem by pressurizing the unvented tank resulting in flooding of the engine during its operation and in turn the exhaust of excessive unburned fuel to the atmosphere.

It is an object of the invention to provide a fuel control or management system which can be used with two or four cycle engines which predetermined quantity of fuel is injected to the mixing chamber for each intake stroke of the engine.

It is another object of the invention to provide a fuel control system in which the required amount of fuel is delivered to the engine for all levels of operation without requiring the use of a return line for excess fuel to the fuel tank.

Another object of the invention is to provide a fuel control system in which predetermined amounts of fuel are metered to the pump and a predetermined amount of fuel is delivered to the engine for each intake stroke of the engine.

Still another object of the invention is to provide a fuel supply system having a pump with a variable volume intake and a positive displacement discharge.

Yet another object of the invention is to provide a fuel supply system in which the fuel delivered is in direct proportion to the engine speed and load and only the required amount of fuel is supplied without requiring a return line to the fuel tank.

A further object of the invention is to provide a fuel supply system in which fuel is metered at a low pressure and the metered amount is delivered at a positive pressure to the engine combustion chamber.

The objects of the invention are achieved by a fuel system for an engine in which a mixing passage for receiving air and fuel is in communication with the combustion chamber of the engine and fuel is delivered to the mixing passage by a pump receiving fuel from a reservoir in metered amounts under the control of a regulator responsive to speed and load of the engine to the inlet of the pump for delivery for each power stroke of the engine and in which the output of the pump is further modified in response to engine speed settings.

DETAILED DESCRIPTION

The preferred embodiment of the fuel supply system of the fuel supply system of the present invention is described generally as a pulse injection system in that fuel is forced into the air fuel mixing chamber at a positive pressure and the amount of fuel is metered in timed relation with the intake stroke of the engine.

Figure 1:
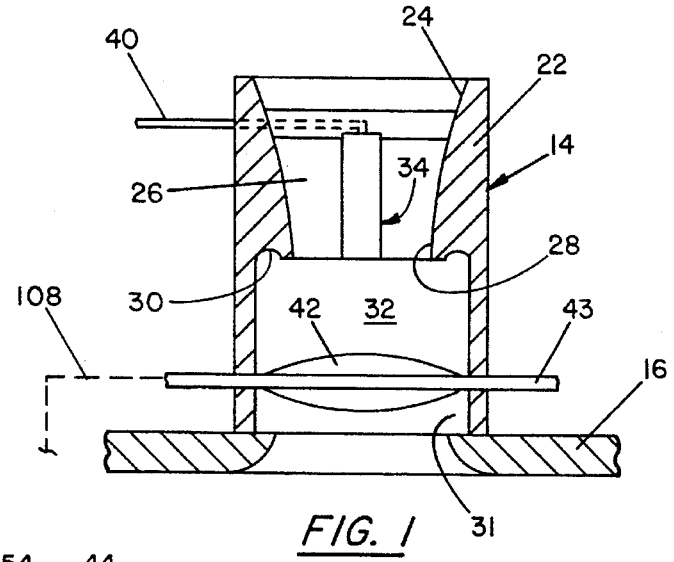
FIG. 1 is a diagrammatic view of the throttle body portion of the fuel supply or management system embodying the invention.
Figure 2:
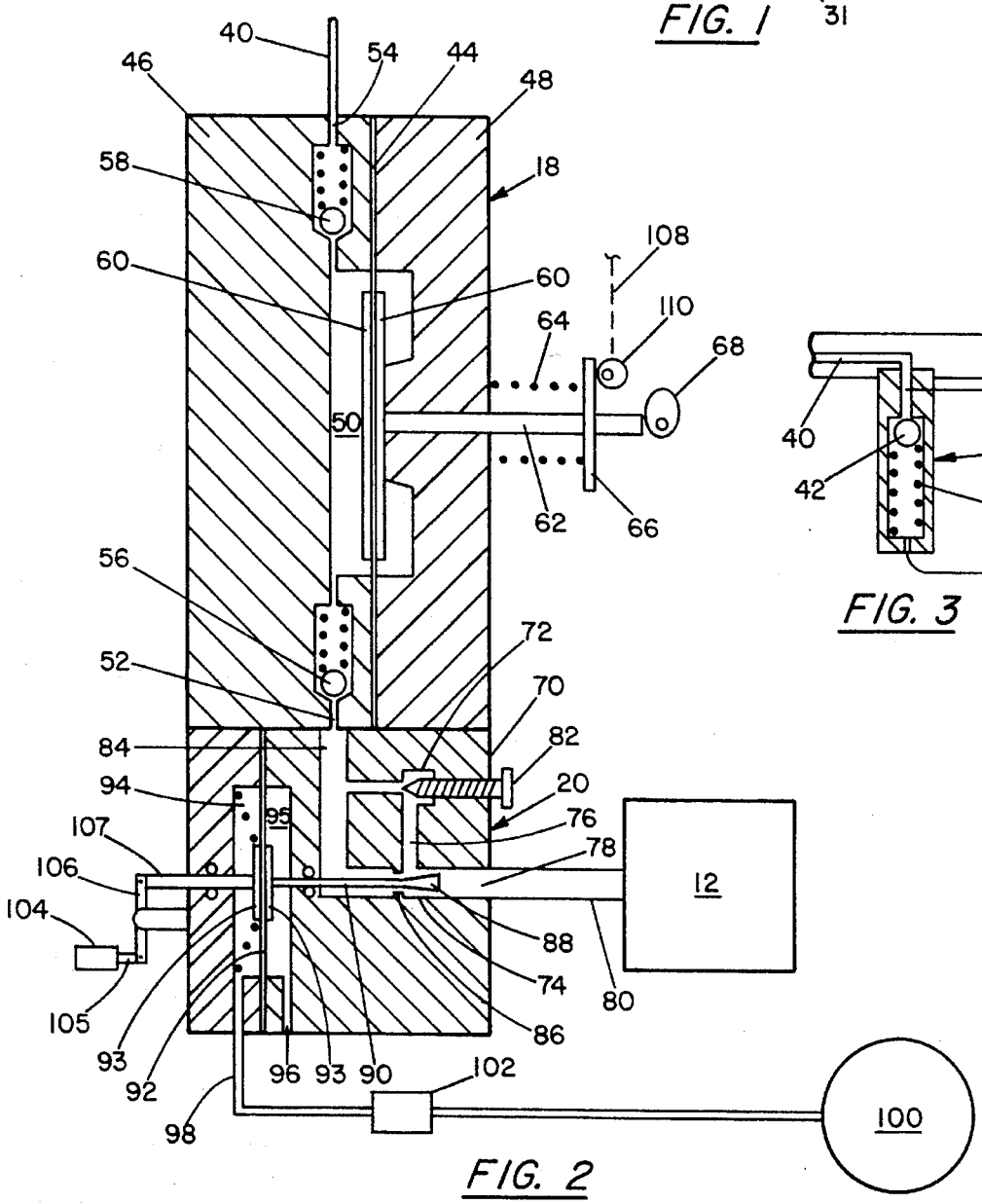
FIG. 2 is a diagrammatic view of pump and metering control used with the mechanism of FIG. 1 to complete the fuel management system.

The fuel supply system 10 is used to control the delivery of fuel from a tank or reservoir 12 seen in FIG. 2 to a throttle body 14 seen in FIG. 1 mounted in communication with the intake manifold 16 of either a two cycle or four cycle engine.

Delivery of fuel is by way of a reciprocating pump 18 which receives metered amounts of fuel regulated by a metering section or fuel control means 20 disposed in the fuel flow path between the tank 12 and the fuel pump 18.

The throttle body 14 includes a housing 22 having an air intake opening 24 at one end which communicates with a passage 26 having a restriction or Venturi section at 28. The Venturi section 28 has an adjacent annular groove 30 facing toward outlet 31 of the passage 26. The Venturi passage 28 acts to create a low pressure effect in a mixing chamber 32 downstream of the Venturi 28. The undercut 30 acts to restrict backflow of the mixture of air and fuel from the mixing passage 32 against the stream of incoming air which can be an undesirable characteristic, particularly at high operating speeds of an engine.

Figure 3:
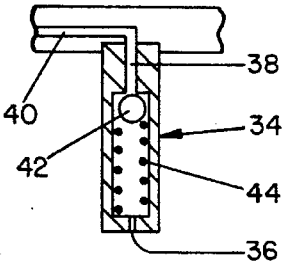
FIG. 3 is a cross sectional view at an enlarged scale of a supply nozzle forming a component of the fuel management system.

Fuel is delivered to the mixing chamber 32 by way of a nozzle 34 which is disposed axially of the passage 26. The nozzle 34 is generally cylindrical and as seen in FIG. 3, has a small discharge opening indicated at 36 through which fuel is discharged into the mixing passage or chamber 32. The end of the nozzle 34 opposite to the discharge opening 36 has a passage 38 which receives fuel from the pump 18 by way of a fuel delivery conduit 40. The fuel passage 38 has a ball check valve 42 which is urged to its closed position on one end of passage 38 by a spring 44.

The discharge end of the nozzle 34 is positioned in close proximity to the Venturi section 28 as seen in FIG. 1. Fuel is discharge from the orifice 36 of the nozzle 34 into the mixing passage 32 where it is mixed with air introduced into the intake opening 24 of the throttle body 14. The amount of air is under the control of a conventional butterfly type of throttle valve 42 which is supported on a shaft 43 extending transversely to the axis of passage 26.

The pump 18, by which fuel is delivered to the nozzle 34, includes a flexible, flat diaphragm 44 clamped between a pair of housing members 46 and 48. The diaphragm 44 forms a fuel chamber 50 at one of its sides in the housing member 46.

Chamber 50 receives fuel from an inlet 52 and delivers it to an outlet 54. The inlet 52 is under the control of a ball type check valve 56 and the outlet 54 is under the control of ball type check valve 58. The central portion of the diaphragm 44 has a pair of backing plates 60 at opposite sides of the diaphragm 44 which serve to connect the diaphragm 44 to an actuating rod 62. The actuating rod 62 is supported for reciprocating movement in the housing 18 and is continuously urged toward the right by a spring 64 acting between the housing 48 and a flange 66 on the rod 62.

A drive cam 68 is supported to engage the end of the actuating rod 62 so that rotation of the cam serves to reciprocate the pump rod 62. The cam 68 is driven in timed relation to the engine and rotates once for every fuel cycle of operation of the engine. In a two cycle engine the cam 68 is rotated by the crankshaft so that cam 68 rotates once for every two strokes. In a four cycle engine the cam 68 is driven by the valve camshaft (not shown) so that drive cam 68 rotates once for every two engine revolutions or every four strokes of the engine.

Upon rotation of the drive cam 68, rod 62 is forced to the left to flex the diaphragm 44 to reduce the volume of chamber 50 and force fuel from the chamber through the open check valve 58. Further rotation of the cam 68 permits the spring 64 to return the rod 62 in a return direction to cause the chamber 52 to increase in volume and create a suction which closes check valve 58 and draws fuel through the open check valve 56 into the chamber 50.

Continuous rotation of the cam 68 causes reciprocation of the rod 62 so that upon leftward movement of the rod 62 fuel is positively forced from the chamber 50 during which time the check valve 56 closes and the check valve 58 opens. Upon completion of each leftward movement, the spring 64 acts to return the rod 62 towards the right creating a suction in the chamber 50 which draws fuel through the open check valves 56 while the check valve 58 is urged to a closed position by its associated spring, positive pressure in line 40 and negative pressure in the chamber 50.

The metering or control device 20 acts to meter controlled amounts of fuel from the tank 12 to the inlet 52 of the pump 18. The metering section 20 includes a housing 70 which can be attached directly to the pump housing 46, 48. The pump 18 and metering control 20 can be formed in one unit and can be mounted on the engine separate of the throttle body 22 but preferable in close proximity.

The metering control 20 includes an idle speed circuit indicated generally at 72 and a high speed circuit indicated generally at 74.

The idle speed circuit includes an idle speed passage 76 that communicates with an inlet 78 receiving fuel from the fuel tank 12 by way of a fuel line 80. An adjustable screw valve 82 makes it possible to regulate the effective size of the passage 76 which communicates with a main passage 84 in direct communication with the pump inlet 52. In some applications the screw valve 82 is used initially to set the idle speed passage and thereafter is made inoperative so that it cannot be adjusted by an operator. It is the present trend to make such adjustments inaccessible to maintain the integrity of the system so that excessive emissions do not result from improper adjustment.

The inlet 78 also is in communication with the main passage 84 by way of a valve seat 86. The effective size of the opening formed by the valve seat 86 is under the control of a conical valve head 88 connected by a stem 90 attached to a diaphragm 92 by way of backing plates 93 at opposite sides of the diaphragm. The diaphragm 92 forms a chamber 94 at one side and a chamber 95 at the other, both in the housing 70. The chamber 95 is an atmospheric chamber which is vented to the atmosphere by passage 96. The chamber 94 at the other side of the diaphragm is connected by way of a line 98 to a source of an engine vacuum 100. The source of engine vacuum 100 can be the crankcase of a two cycle engine or a point on the intake manifold of a four cycle engine. In either case, the pulsations of vacuum are dampened by an expansion chamber 102 in line 98 and the level of vacuum pressure is responsive to engine speed and loading so that variations in the vacuum are made apparent in the vacuum chamber 94 at the left side of the diaphragm 92. The resultant pressure differential of atmospheric chamber 95 and variable vacuum in chamber 94 acting on the diaphragm 92 causes movement of the valve head 88 in FIG. 2 to regulate the effective size of the valve seat 86 to control the volume of fuel that can pass from the tank 12 to the main passage 84 and to the pump 50.

Since the volume of fuel delivered to the pump is metered to correspond to engine demands, the output volume is variable. As a consequence, when small quantities of fuel are metered to the pump, the diaphragm 44 will be limited in how far it can deflect to the right under the action of the spring 64. Such movement will be substantially less than the full stroke of the pump when minimum quantities are metered to the pump. When the rod 62 is allowed to return to the right at something less than full stroke the end of rod 62 will not maintain continuous contact with drive cam 68 during its entire revolution but only to the extent required to force the metered, small volume of fuel from chamber 50. In this respect, the pump 18 is a variable volume, positive displacement pump by which a premeasured amount of fuel is delivered to the engine for each power stroke.

The output volume of the pump is further modified by limiting the stroke of the pump in response to the speed setting of the engine. Engine speed is regulated by throttle valve 42 which is operatively connected through shaft 43 by mechanism indicated by dash line 108 with a rotatable eccentric stop element 110 seen in FIG. 2. Stop element 110 is positioned in proximity to flange 66 so that in the open position of valve 42, the pump rod 62 can move through its full stroke. As the throttle valve is moved toward its closed position, the stop 110 rotates to engage flange 66 and limit the stoke of rod 62. In this manner, the pulses or charges of fuel become greater at high speed and can be at a minimum at low speed unless further modified by fuel control 20.

Although pulses or charges of fuel are injected at a positive pressure, discharge of fuel from the nozzle is further enhanced by the suction of air at the Venturi section 28.

If desired the effect of an automatic choke to enhance cold starting of an engine can be achieved with the thermal control unit indicated at 104. The characteristics of such thermal units or actuators, which are commercially available from Caltherm Corporation, Bloomfield Hills, Mich., are that at low temperatures a piston rod 105 is in its retracted position and as temperature increases the rod 105 is extended. By connecting such a unit 104 through a pivot arm 106 to a stop rod 107, the rod 107 will engage diaphragm 92 and cause the stem 90 to hold the valve head 88 in its open position for additional fuel as required when the engine is started at low temperature. As the engine starts operating and temperatures increase, the rod 105 extends to pull the stop rod 107 away from the diaphragm to allow it to be actuated normally by vacuum in chamber 94 of the fuel control device 20.

In operation, the engine is started by rotation of its crankshaft which also causes rotation of the drive cam 68 so that the actuating rod 62 of the pump 18 is reciprocated a limited distance as determined by stop 110. With fuel in the chamber 50 the pumping operating begins and a pulse or charge of fuel is delivered through line 40 to the nozzle 34 and into the mixing chamber 32. The resultant air fuel mixture, a portion of which passes the partially closed throttle valve 42, is delivered to the intake manifold 16 and to the combustion chamber of the engine where it can be detonated to obtain powered rotation of the engine.

After the engine rotation begins, the throttle valve 42 can be moved to its fully open position for full speed operation of the engine. This causes the rotatable stop member 110 to move to a position which extends the length of the stroke of pump 18 and increases the quantity of each pulse of fuel. After the engine has obtained full operating temperature, the stop rod 107 will become retracted so that the diaphragm 92 can respond to the vacuum in chamber 94. At high engine speed the vacuum level will be lower than at low speed and as a consequence the valve 86, 88 will be in a relatively open position so that the predetermined amounts of fuel delivered to the pump 18 will be sufficiently large to accommodate the requirements of high speed operation.

When the engine is operating at high speed and the throttle valve 42 is moved to its closed position, the vacuum level in chamber 94 will immediately increase to pull the valve 88 to a relatively closed position so that smaller amounts of fuel are metered to the pump 18 for low speed operation.

At whatever speed the engine is operating, if ignition is terminated to stop the engine, check valves 56 and 58 associated with the pump 18 and the check valve 42 associated with the injector nozzle 34 will immediately be returned by associated springs to their closed position thereby preventing undesirable fuel flow and the emission of unburned fuel.

A fuel supply system has been provided in which fuel is delivered in pulses for each power stroke of the engine with the quantity of each pulse being determined by speed and load on the engine by a control which modifies the effective operation of a reciprocating fuel pump by metering fuel available to the intake of the fuel pump and by modifying the effective stroke of the pump and therefore the fuel delivered in accordance with the speed of the engine so that only the amount of fuel required is delivered thereby eliminating the need for return lines to handle excess fuel.

I claim:

1. A fuel supply system for a reciprocating engine, the combination comprising:

a throttle body for receiving air and fuel and delivering a mixture thereof to an engine cylinder, a source of fuel, a reciprocating pump receiving fuel from said source and delivering it to said throttle body, said pump having a variable volume intake and a positive displacement output, said pump having a diaphragm forming a fuel intake chamber, control means between said source and said pump for delivering predetermined amounts of fuel to said fuel intake chamber for each intake stroke of said engine, said predetermined amounts of fuel being proportional to the speed of and load on said engine, said control means includes a valve between said source and said pump responsive to vacuum in the crankcase of the engine to move from a fully open position in the presence of a low vacuum level to a partially closed position in the presence of a high vacuum level.

2. A fuel supply system for an engine, the combination of:

a source of engine vacuum proportional to engine speed and load, a fuel reservoir, a mixing passage for receiving air and fuel, a nozzle for delivering fuel to said passage, a throttle valve for controlling the delivery of air to said passage, a pump having an inlet for receiving fuel from said reservoir and an outlet for delivering fuel to said nozzle, and control means having a low speed fuel passage and a high speed fuel passage for regulating the amount of fuel delivered from said reservoir to said inlet of said pump in response to the level of vacuum in said source.

3. A fuel supply system for a reciprocating engine, the combination comprising:

a throttle body for receiving air and fuel and delivering a mixture thereof to an engine cylinder, a source of fuel, a variable volume, positive displacement pump having an inlet for receiving fuel and an outlet for delivering it to said throttle body, said pump being driven in timed relation to the reciprocation of said engine, and a source of vacuum pressure proportional to speed and load on said engine, control means between said source of fuel and said pump being responsive to the level of vacuum in said source of vacuum to permit delivery of fuel to said intake of said pump in proportion to the level of said vacuum in said source of vacuum whereby predetermined amounts of fuel are delivered from said pump to said throttle body for each intake stroke of said engine in proportion to the speed and load on said engine.

4. The combination of claim 1 and further comprising a nozzle receiving fuel from said pump and having a delivery end in said throttle body for delivering predetermined amounts of fuel.

5. The combination of claim 4 wherein said predetermined amounts of fuel are delivered in response to each reciprocation of said pump.

6. The combination of claim 1 and further comprising a temperature responsive stop element preventing movement of said vane from its fully open position at low temperatures and permitting movement toward a closed position at higher temperatures.

7. The combination of claim 1 wherein said pump is a reciprocating pump having a stroke variable in response to the position of said throttle valve.

8. The combination of claim 7 wherein said stroke is at a maximum when said valve is fully open and at a minimum when said valve is closed.

9. The combination of claim 2 in which said pump reciprocates and has an intake stroke in one direction and a delivery stroke in the other direction.

10. The combination of claim 2 wherein said nozzle receives fuel from said pump and has an outlet passage disposed in said throttle body to deliver a predetermined quantity of fuel at a positive pressure for each delivery stroke of said pump.

11. The combination of claim 2 wherein said high speed passage is variable in size.

12. The combination of claim 11 wherein said high speed passage is enlarged in response to a decrease in vacuum level in said source.

13. The combination of claim 11 and further compressing temperature responsive mechanism operative to enlarge said high speed passage in response to a temperature below normal.

14. The combination of claim 2 and further comprising means for limiting the stroke of said pump in response to the position of said throttle valve.

15. The combination of claim 2 wherein said pump has a full stroke when said throttle valve is in a closed position and a minimum stroke when said throttle valve is in a fully open position.

16. The combination of claim 3 wherein said control means includes a valve movable between fully open and partially closed positions in response to a low level and a high level, respectively, of vacuum in said source of vacuum.

* * * * *